US010119794B2

(12) United States Patent
Masserant et al.

(10) Patent No.: US 10,119,794 B2
(45) **Date of Patent: *Nov. 6, 2018**

(54) ENTANGLEMENT OBSTACLE

(71) Applicant: Mid-American Gunite, Inc., Newport, MI (US)

(72) Inventors: Keith Masserant, Newport, MI (US); Craig Van Camp, Tecumseh, MI (US)

(73) Assignee: Mid-American Gunite, Inc., Newport, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/692,523

(22) Filed: Aug. 31, 2017

(65) Prior Publication Data

US 2017/0363395 A1 Dec. 21, 2017

Related U.S. Application Data

(63) Continuation of application No. 15/026,851, filed as application No. PCT/US2014/061516 on Oct. 21, 2014, now Pat. No. 9,784,537.

(60) Provisional application No. 61/894,616, filed on Oct. 23, 2013.

(51) Int. Cl.
*F41H 11/08* (2006.01)
*E04B 1/19* (2006.01)

(52) U.S. Cl.
CPC ..... *F41H 11/08* (2013.01); *E04B 1/19* (2013.01); *E04B 2001/1984* (2013.01); *E04B 2001/1993* (2013.01)

(58) Field of Classification Search
CPC ..... E04B 1/19; E04B 2001/1984; E04B 2001/1993; F41H 11/08
See application file for complete search history.

(56) References Cited

U.S. PATENT DOCUMENTS 3,008,711 A * 11/1961 Dillon ..... A63B 9/00 273/122 A
3,970,301 A * 7/1976 Lehmann ..... A63B 9/00 428/542.6
5,330,400 A * 7/1994 Huberman ..... A63B 9/00 482/121
5,405,304 A * 4/1995 Petersheim ..... A63B 9/00 434/258

(Continued)

*Primary Examiner* — Paola Agudelo
(74) *Attorney, Agent, or Firm* — Quinn IP Law

(57) ABSTRACT

An entanglement obstacle for obstructing an area of a surface includes a mesh layer suspended over upright perimeter members via a perimeter cable and over upright central members via a central cable. The upright members are operatively attached to the surface. The perimeter cable is operatively attached to the perimeter members at a perimeter clearance above the surface to provide a trip impediment. The central cable is operatively attached to the central members at a central clearance above the surface to provide a step-over impediment. The central clearance is greater than the perimeter clearance. The mesh layer is operatively attached to the perimeter and central cables such that the mesh layer covers the obstructed area to provide an entanglement obstacle. The mesh layer is inclined from the central cable to each of first and second sides of the obstacle at an angle defined by the central perimeter clearances.

20 Claims, 8 Drawing Sheets

(56) References Cited

U.S. PATENT DOCUMENTS

| | | | | | |
|---|---|---|---|---|---|
| 5,482,374 | A * | 1/1996 | Buhyoff | A45B 23/00 | 383/4 |
| 5,584,311 | A * | 12/1996 | Schaefer | E04H 15/34 | 135/120.3 |
| 6,017,174 | A * | 1/2000 | Ross | B60P 7/0876 | 410/100 |
| 6,857,246 | B2 * | 2/2005 | Erbetta | E04H 15/36 | 135/124 |
| 7,008,154 | B1 * | 3/2006 | Nolle | B60R 7/005 | 410/118 |
| 8,083,648 | B2 * | 12/2011 | Koehler | A63B 9/00 | 114/89 |
| 9,320,353 | B1 * | 4/2016 | Elze | A47B 37/04 | |
| 9,784,537 | B2 * | 10/2017 | Masserant | E04B 1/19 | |
| 2004/0163302 | A1 * | 8/2004 | Hong | A01K 69/10 | 43/105 |
| 2006/0272230 | A1 * | 12/2006 | Elwood | A63B 71/02 | 52/182 |
| 2008/0283386 | A1 * | 11/2008 | Kaufman | H01Q 1/366 | 204/164 |
| 2011/0085040 | A1 * | 4/2011 | Joslyn | G08B 13/196 | 348/157 |
| 2013/0061898 | A1 * | 3/2013 | Webster | E04H 15/008 | 135/156 |

* cited by examiner

ENTANGLEMENT OBSTACLE

CROSS REFERENCES TO RELATED APPLICATIONS

This Application claims the benefit of U.S. Non-Provisional application Ser No. 15/026,851 filed Apr. 1, 2016, International Patent Application PCT/US2014/061516 filed Oct. 21, 2014 and U.S. Provisional Application 61/894,616, filed Oct. 23, 2013, which are hereby incorporated by reference in their entirety.

TECHNICAL FIELD

The present disclosure relates to an obstacle to impede or disrupt the movement of a person toward a target, and more specifically relates to an entanglement obstacle.

BACKGROUND

One or more obstacles may be strategically placed near or adjacent a target to reduce the potential of access to the target by one or more unauthorized persons, which may be generally referred to as intruders, by impeding or disrupting movement of the intruder or intruders toward the target. The target, which may also be referred to as a protected area, may be an area of property which may contain, for example, facilities, buildings, equipment, materials, and/or people which require protection. The target may be configured for a particular use, for example, as a road, bridge, air strip, etc. or may provide a particular resource, such as water, food, or energy, such that protection of the target from intruders is desirable.

Entanglement obstacles such as tanglefoot obstacles may be constructed to obstruct an area adjacent the protected area to impede or disrupt movement of an intruder on foot. Constructing a tanglefoot obstacle can be labor and time intensive, and may include stringing razor or barbed wire in a complex and/or multilayer pattern using a grid of posts extending throughout the entire surface of the obstructed area and attaching the barbed wire to each of the posts in the grid using additional wire wrap and specialized equipment such as wire gauntlet gloves, etc. Razor wire and barbed wire can be heavy to transport and difficult to manipulate during installation, presenting an injury risk to installers. The removal of razor wire and barbed wire installations are labor intensive and time consuming and the removed wire materials may not be readily disposable or reusable.

SUMMARY

An entanglement obstacle for obstructing an area of a surface includes a mesh layer suspended over and operatively attached to upright perimeter members via a perimeter cable and to upright central members via a central cable. In an installed position, the upright members are operatively attached to the surfaces at intervals to define the obstructed area. The obstacle and the obstructed area covered by the obstacle are characterized by an obstacle length and an obstacle depth. In one example, the obstacle depth is at least 30 feet. The obstacle length is unlimited such that the obstacle can be configured to define a boundary between first and second sides of the obstacle extending the obstacle length, such that the obstacle separates, for example, a protected area on one side of the obstacle from an intruder or attack area on the other side of the obstacle. The obstacle can be configured to surround or enclose a protected area.

The perimeter cable is operatively attached to the perimeter members at a perimeter clearance above the surface to provide a trip impediment. The central cable is operatively attached to the central members at a central clearance above the surface to provide a step-over impediment, where the central clearance is greater than the perimeter clearance. A mesh layer is operatively attached to the perimeter members via the perimeter cable and to the central members via the central cable such that the mesh layer is suspended across the plurality of central members and the plurality of perimeter members and covers the obstructed area to provide an entanglement obstacle. The central cable is disposed within a periphery defined by the perimeter cable such that the mesh layer is inclined from the central cable at an angle defined by the central clearance and the perimeter clearance to each of a first and second side of the obstacle defined by the perimeter members.

The entanglement obstacle disclosed herein is advantaged by its capability to impede or disrupt movement of an intruder on foot, by entangling the intruder in the mesh layer and/or presenting a barrier to forward movement of the intruder, thus impeding movement of the intruder toward a target and/or forcing the intruder into an upright position, for example, during attempts by the intruder to disengage from the entanglement obstacle presented by the mesh layer, thereby increasing visibility of the intruder to surveillance and/or to offensive actions to contain and/or prevent further movement of the intruder toward the target.

By way of example, the entanglement obstacle is constructed by operatively attaching a first group of perimeter members to the surface, where the first group of perimeter members are distributed at intervals along the length of the obstacle to define a first side of the obstacle, where the obstructed area meets one of the protected and intruder areas. A second group of perimeter members are distributed at intervals along the length of the obstacle and are operatively attached to the surface to define the second side of the obstacle where the obstructed area meets the other one of the protected and intruder areas. The central members are distributed at intervals along the length of the obstacle and are operatively attached to the surface such that the central members are centrally located between the first and second sides of the obstacle. A perimeter cable is operatively attached to the plurality of perimeter members such that the perimeter cable defines a periphery of an obstructed area of the surface. The perimeter cable is attached to the perimeter members such that a perimeter clearance is defined between the perimeter cable and the surface, and the perimeter cable presents a tripping impediment. A central cable is operatively attached to the plurality of central members such that the central cable defines a central clearance between the central cable and the surface, where the central clearance is greater than the perimeter clearance, and the central cable presents a step-over impediment.

A mesh layer is operatively attached to the perimeter members via the perimeter cable and to the central members via the central cable such that the mesh layer is suspended across the plurality of central members and the plurality of perimeter members above the surface to cover the obstructed area. The central cable is disposed within the periphery defined by the perimeter cable and is intermediate the first and second sides and extends the obstacle length such that the mesh layer is inclined from the central cable to each of the first side and the second side of the obstacle at an angle defined by the central clearance and the perimeter clearance. The mesh layer includes a plurality of mesh openings such that the mesh layer presents an entanglement obstacle configured to entrap and entangle the feet and/or limbs of an intruder or attacker attempting to cross-over and/or breach the obstacle.

The entanglement obstacle may further include one or more tripping obstacles disposed between the surface and the mesh layer. The tripping obstacles may be configured, by way of non-limiting example, as one or more of a second mesh layer suspended between the first mesh layer and the surface, at least one concertina coil disposed between the first mesh layer and the surface, rocks, broken concrete, irregularities in the surface of the obstructed area such as furrows and ditches, or a combination of these. One or more detection devices may be deployed with the entanglement obstacle. The detection devices may be actuable to detect an intruder presence in the obstructed area, and/or to detect movement of at least one of the perimeter cable, the mesh layer, and the central cable. The entanglement obstacle may be camouflaged.

The entanglement obstacle provided herein is further advantaged by features to prevent or impede breaching of the entanglement obstacle. For example, the mesh layer can be made of a flame retardant, flame resistant and/or self-extinguishing material, to prevent or mitigate damage to the obstacle by fire. The perimeter and central cables pass through openings in the upright members and are retained on either side of each member adjacent the opening such that cutting the cable limits the cut opening to a distance no greater than the distance between adjacent upright members. The mesh layer is suspended with a predetermined level of dynamic slack such that the mesh layer is not completely taut and is movable in response to an object contacting the mesh layer, such that objects launched at the obstacle may bounce off and/or make contact with a decreased impact force to prevent detonation or minimize impact damage to the mesh layer.

The above features and advantages and other features and advantages of the present disclosure will be readily apparent from the following detailed description of the preferred embodiments and best modes for carrying out the present disclosure when taken in connection with the accompanying drawings and appended claims.

DETAILED DESCRIPTION

Figure 1:
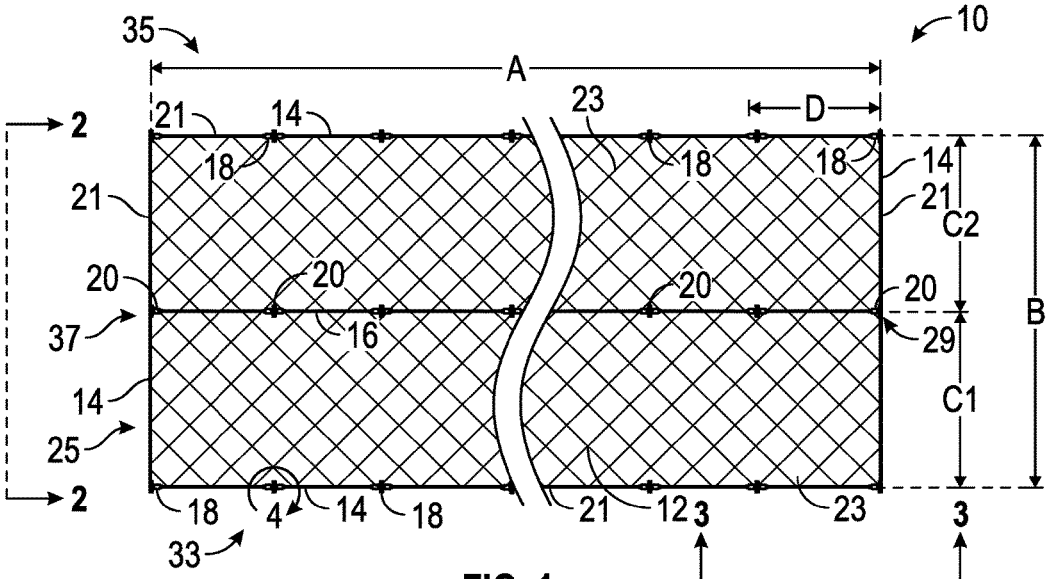
FIG. 1 is a schematic top view of an entanglement obstacle covering an obstructed area.

The elements shown in FIGS. 1-15 are not necessarily to scale or proportion. Accordingly, the particular dimensions and applications provided in the drawings presented herein are not to be considered limiting. As used herein, the terms "a," "an," "the," "at least one," and "one or more" are interchangeable and indicate that at least one of an item is present. A plurality of such items may be present unless the context clearly indicates otherwise. All numerical values of parameters, quantities, or conditions in this disclosure, including the appended claims, are to be understood as being modified in all instances by the term "about" or "approximately" whether or not "about" or "approximately" actually appears before the numerical value. "About" and "approximately" indicate that the stated numerical value allows some slight imprecision (e.g., with some approach to exactness in the value; reasonably close to the value; nearly; essentially). If the imprecision provided by "about" or "approximately" is not otherwise understood with this meaning, then "about" and "approximately" as used herein indicate at least variations that may arise from methods of measuring and using such parameters. Further, the terminology "substantially" also refers to a slight imprecision of a condition (e.g., with some approach to exactness of the condition; approximately or reasonably close to the condition; nearly; essentially). In addition, disclosed numerical ranges include disclosure of all values and further divided ranges within the entire range. Each value within a range and the endpoints of a range are all disclosed as separate embodiments. The terms "comprising," "includes," "including," "has," and "having" are inclusive and therefore specify the presence of stated items, but do not preclude the presence of other items. As used in this disclosure, the term "or" includes any and all combinations of one or more of the listed items.

Figure 2:
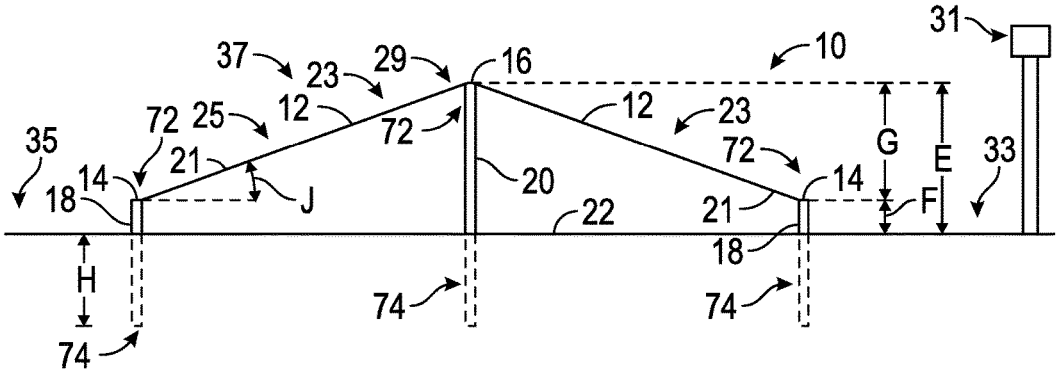
FIG. 2 is a schematic side view section 2-2 of the entanglement obstacle of FIG. 1.

Referring to the drawings wherein like reference numbers represent like components throughout the several figures, an entanglement obstacle generally indicated at 10 is shown in FIGS. 1 and 2. The entanglement obstacle 10 includes a mesh layer 25 operatively attached along its periphery 21 via a perimeter cable 14 to a plurality of perimeter posts 18 such that the mesh layer 25 is suspended over an obstructed area generally indicated at 37. The perimeter posts 18 may also be referred to herein as upright members and/or as perimeter members. The obstructed area 37 is located such that the obstructed area 37 lies between a protected area generally indicated at 33 and an intruder area generally indicated at 35, such that the entanglement obstacle 10 is located between the protected and intruder areas 33, 35 and must be crossed over from the intruder area 35 by an intruder on foot attempting to access the protected area 33. The protected area 33 may also be referred to herein as the protected side or defended side relative to the entanglement obstacle 10. The intruder area 35 may also be referred to herein as the intruder side, approach side, the enemy side, or the attack side relative to the entanglement obstacle 10.

The entanglement obstacle 10 covers the obstructed area 37 and has an obstructed depth B defined by the distance between the perimeter posts 18 on the protected side and the opposing perimeter posts 18 on the intruder side. As shown in FIGS. 1 and 2, the mesh layer 25 is attached to the perimeter posts 18 and to a plurality of central posts 20 disposed between the first group of perimeter posts 18 defining the portion of the periphery 21 bounding the protected area 33 and the second group of perimeter posts 18 defining the portion of the periphery 21 bounding the intruder area 33, such that the mesh layer 25 extends an obstructed length A and an obstructed depth B of the entanglement obstacle 10, and is suspended over the surface 22 to define the obstructed area 37. The central posts 20 may also be referred to herein as upright members and/or as central members. A central cable 16 is attached to each of the central posts 20. The mesh layer 25 is operatively attached to the central posts 20 via the cable 16.

Figure 13:
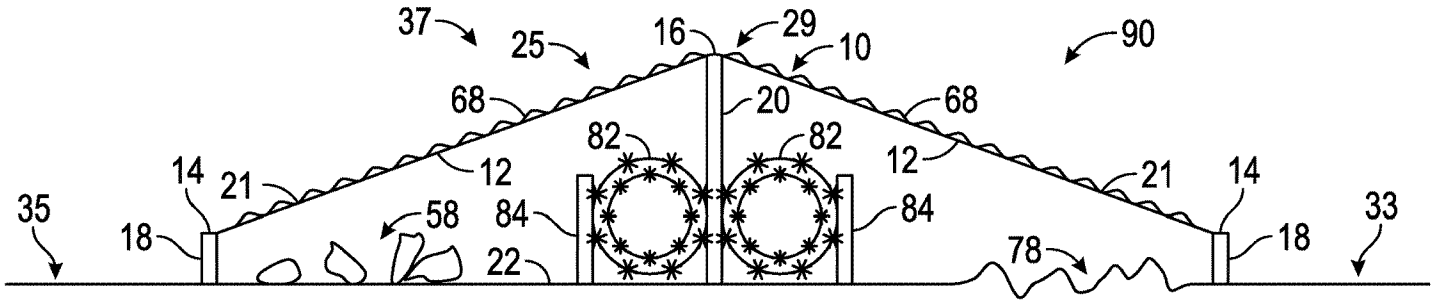
FIG. 13 is a schematic end view of a combination entanglement obstacle including the entanglement obstacle of FIG. 1.

As shown in FIG. 1, the perimeter posts 18 may be spaced at post intervals D along the obstructed length A on each of the intruder side and protected side of the entanglement obstacle 10. The central posts 20 may be spaced at post intervals D along the obstructed length A. By way of example, the post interval D may be between 6 feet (approximately 2 meters) and 15 feet (approximately 5 meters). In one example, the post interval D is at least 10 feet and preferably 12 feet (approximately 4 meters). It would be understood that the entanglement obstacle 10 described herein requires posts 18, 20 only at the periphery 21 and along a central portion 29 of the obstructed area 37 covered by the mesh layer 25, and, as such, requires substantially fewer posts 18, 20 per square foot of obstructed area 37 than, for example, a conventional barbed wire or razor wire tanglefoot barrier, which may require posts placed at 2 to 6 foot intervals across the entire expanse of the obstructed area 37. As a result, the installation time and labor required to erect an entanglement obstacle 10 as shown in FIGS. 1-2 is substantially less than that required to erect a wire tanglefoot barrier covering the same amount of obstructed area 37, and the amount, cost and weight of post materials to erect the entanglement obstacle 10 as shown in FIGS. 1-2 is substantially less than that required to erect a wire tanglefoot barrier covering the same amount of obstructed area 37. Further, because only perimeter posts 18 and central posts 20 are used to support the entanglement obstacle 10, and no additional posts are used or required, the entanglement obstacle 10 can be erected over rough and/or rocky terrain, swampy areas, water hazards, etc. where the irregularities in and/or characteristics of the terrain can be combined with the entanglement obstacle 10 to provide a combination obstacle. Similarly, as shown in FIG. 13, tripping obstacles 58 such as rocks, broken concrete, etc., and terrain obstacles such as trenches, furrows, or other entanglement and/or tripping obstacles such as concertina coils 82 can be positioned under the entanglement obstacle 10 to provide a combination entanglement obstacle 90. In the example shown in FIG. 13, the concertina coils 82 may be held in position by concertina support posts 84 such that the meshed layer extends over the concertina coils 82 to camouflage the concertina coils 82 or otherwise reduce the detectability of the concertina coils 82 by intruders and/or to maintain a clearance between the concertina coils 82 and the mesh layer 25 such that the mesh layer 25 does not become entangled in the concertina coil 82 in the absence of an intruder presence.

In the example shown, a continuous length of mesh layer 25 extends the obstructed length A, which may be of any length sufficient as required to deter or impede intruders from the protected area 33. It would be understood the continuous length of mesh layer 25 may be comprised of one or more mesh panels 23 operatively attached to each other. By way of non-limiting example, the mesh layer 25 may extend an obstructed length A of at least 100 feet. In one example, the mesh layer 25 extends an obstructed length A of at least 500 feet. In another example, the mesh layer 25 extends an obstructed length A of greater than 800 feet.

A central portion 29 of the mesh layer 25 extending the obstructed length A of the entanglement obstruction is operatively attached via the central cable 16 to a plurality of central posts 20, and such that the central portion 29 of the mesh layer 25 is elevated relative to the periphery 21 portions of the mesh layer 25 adjacent the protected and intruder areas 33, 35. The perimeter posts 18 are configured to attach the perimeter cable 14 and periphery 21 of the mesh layer 25 at a perimeter height F, such that the perimeter cable 14 is extended above the ground surface 22 at a height F where the perimeter cable 14 presents a trip impediment to an intruder on foot, yet is sufficiently close to the ground surface 22 to interfere with an intruder attempting to climb or crawl under the perimeter cable 14. By way of example, the perimeter height F may be between 4 to 8 inches (approximately 10 to 20 cm). In one example, the perimeter posts 18 are approximately 6 inches (approximately 15 cm) in height such that the perimeter cable 14 affixed to the post top 72 of the perimeter post 18 is at a perimeter height F of 6 inches (15 cm), where the perimeter height F may also be referred to herein as the perimeter clearance. The central posts 20 are configured to attach the central cable 16 and central portion 29 of the mesh layer 25 at a central height E, such that the central cable 16 is extended above the ground surface 22 at a height E where the central cable 16 presents a step-over impediment to an intruder on foot, and is located sufficiently above the ground surface 22 such that an intruder must step over the central cable 16 from an upright position to clear the central cable 16. By way of example, the central height E may be between 12 to 28 inches (approximately 30 to 72 cm). In one example, the central posts 20 are approximately 18 to 24 inches (approximately 45 to 62 cm) in height such that the central cable 16 affixed to the post top 72 of the central post 20 is at a central height E of at least 18 inches (45 cm), wherein the central height E may also be referred to herein as the central clearance.

The entanglement obstacle 10 is configured to impede or disrupt movement of an intruder on foot by tripping the intruder on the perimeter cable 14 and/or entangling the foot or feet of the intruder in the mesh of the mesh layer 25 to impede movement of the intruder across the obstructed area 37, e.g., to impede progress toward the protected area 33, and/or to force the intruder into an upright position, for example, during attempts by the intruder to disengage a foot tangled in the mesh layer 25 or to step over the central cable 16, thereby increasing visibility of the intruder to surveillance and/or increasing the susceptibility of the intruder to offensive actions to contain and/or prevent further movement of the intruder toward the target. Similarly, the entanglement obstacle 10 including the mesh layer 25 is configured to impede or disrupt movement of an intruder on foot attempting to crawl over the surface of the mesh layer 25, by entangling the feet, legs, hands, and/or arms of an intruder in the mesh openings 27 of the entanglement obstacle 10.

The entanglement obstacle 10 may be configured to provide an obstructed depth B sufficient to deter and/or impede progress of an intruder or intruders, to provide time to observe the intruder(s), to take offensive action to prevent further movement of the intruder(s) toward the protected area 33, and/or to otherwise defend the protected area 33 from the intruder(s). By way of example, the obstructed depth B provided by the entanglement obstacle 10 may be at least 30 feet (approximately 9 meters) across. In one example, the obstructed depth B is 38 to 40 feet across (approximately 11.6 to 12.2 meters). In another example, the obstructed depth B is at least 40 feet (approximately 12.2 meters).

Figure 4:
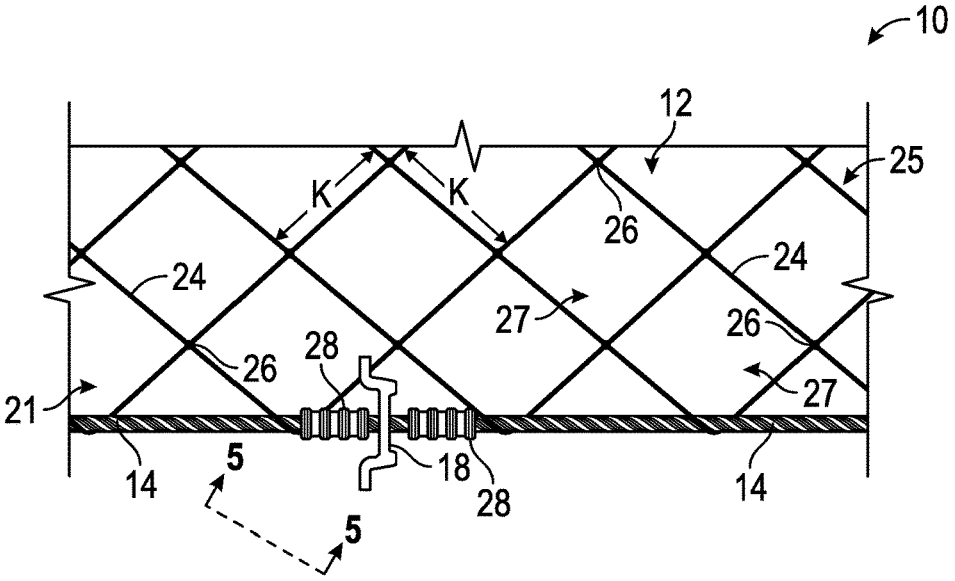
FIG. 4 is a partial top view of section 4 of the entanglement obstacle of FIG. 1.

The mesh layer 25 of the entanglement obstacle 10 is configured to trip and/or entangle the feet of the intruder. As shown in FIG. 4, the mesh layer 25 may define a plurality of openings defined by a mesh dimension K, such that the mesh opening 27 is referred to as having a K x K sized opening. In the example shown, the mesh dimension K is configured to yield a large enough mesh opening 27 such than an intruder would not be able to walk over the suspended mesh layer 25, for example, such that the toe and/or foot of an intruder attempting to traverse the entanglement obstacle 10 will protrude into the mesh opening 27 and/or the toe, foot, ankle and/or leg will be inserted through the mesh opening 27 to entangle, ensnare, or trip the intruder, or impede or otherwise deter movement of the intruder relative to the entanglement obstacle 10. Likewise, it would be understood that the hands, wrists, arms, feet and/or legs of an intruder attempting to crawl over the suspended mesh layer 25 could protrude through the mesh openings 27 and/or become entangled in the mesh layer 25 to impede or otherwise deter movement of the intruder.

By way of example, the mesh layer 25 may be made of a mesh material 12 including a plurality of mesh openings 27 defined by interconnected mesh strands 24 of the mesh material 12, each mesh opening 27 having an unstretched mesh opening 27 which may be a 4.5×4.5 inch, 5×5 inch, 5.5×5.5 inch or 6×6 inch mesh opening 27. In one example, the mesh opening 27 has an open area of greater than 16 square inches or preferably greater than 25 square inches, e.g., has a mesh dimension greater than 4 inches or preferably greater than 5 inches. In a preferred example, each mesh opening 27 is a 5×5 inch (approximately 12.7 cm×12.7 cm) opening, and the mesh openings 27 may be square or diamond shaped openings. The examples provided herein are non-limiting, and other sizes and shapes of mesh openings 27 having an opening large enough to entangle a foot and/or leg, including rectangular, oval, irregular and/or asymmetrical shapes suitable to present an entanglement hazard 62 to an intruder on foot to ensnare, trip, or otherwise impede movement of the intruder across the mesh layer 25 may be used. As such, a mesh opening 27 should not be so large as to allow a foot to pass through without entanglement. In one example, the maximum unstretched mesh opening 27 has an open area no greater than 36 square inches, and a maximum mesh dimension of 6 inches. The size of a non-square shaped opening may be defined by other dimensions, for example, the size of a triangular opening may be described by the lengths of each of the sides of the unstretched triangular opening, the size of a rectangular opening may be described by the length and width of the unstretched opening, etc. The unstretched opening refers to the size or shape of the opening with the mesh layer 25 in an unstretched or as manufactured, uninstalled condition. It would be understood that the mesh layer 25 may be intentionally and/or unintentionally stretched, extended and/or distorted during installation to obtain a predetermined amount of tautness and/or slack in the mesh layer 25 in the installed position, and/or to obtain a predetermined distortion of the shape of the mesh opening 27, for example, from a square to a diamond shape, as may be desirable to orient the shape of the mesh opening 27 relative to the anticipated path of the intruder for tripping and/or entanglement purposes.

The strands of the mesh material 12 comprising the mesh layer 25 may be interconnected to define the plurality of mesh openings 27 by any suitable method. In one example, the strands may be knotted to each other to form the mesh openings 27, and the mesh material 12 may be referred to as a knotted mesh material. In another example, the mesh material 12 may be an unknotted mesh material, where the strands are interconnected by weaving, knitting, fusing, or a joining method other than knotting. In the example shown, the mesh material 12 is a knotted mesh material. The interconnection of the strands defines the mesh opening 27 size and shape and stabilizes the shape of the mesh material 12. Additionally, by interconnecting the strands by knotting, fusing, weaving, knitting or otherwise, breakage of the mesh material 12 by cutting or breaking a strand is limited to the mesh openings 27 defined by the broken strand. For example, breakage of the mesh material 12 due to a single break in a single strand is limited to the two adjacent mesh openings 27 which were defined by the section of broken strand, e.g., the mesh material 12 is configured such that further propagation of the break is stopped by the interconnections (knots 26, for example) adjacent the broken strand ends 108, and such that the break is non-propagating. Accordingly, breakage of the mesh material 12 is limited and/or isolated to those mesh openings 27 which were defined by the broken strand ends 108.

The mesh material 12 may be a polymer based material, an organic or natural fiber based material, a metal containing material, a composite material which may be a polymer based composite material, etc. By way of non-limiting example, the mesh material 12 may be a polymer based material configured to be non-corrosive, flexible, tough, exhibit good impact strength, shape (low creep) and thermal stability, be chemical resistant and/or inert, be abrasion resistant, tear and/or cut resistant, resistant to environmental and weatherability (UV, ozone, oxygen) attack, water resistant and/or substantially non-absorbent.

The mesh material 12 may be a monofilament or polyfilament material. The polymer based material may be a composite material including one or more of a glass, fiber, polymer or metal reinforcing material, an additive, a coating, etc. to provide the combination of properties required by the mesh material 12 in use in the entanglement obstacle 10 described herein. The polymer based material may include and/or be substantially made of one or more of a nylon, polyethylene, or polypropylene material. The material may be a flame resistant material and/or may be coated, treated or formulated to be flame resistant, such that if the mesh layer 25 is attacked by open flame, an explosive device, or other incendiary device, the mesh layer 25 may be self-extinguishing, either by the melting of the mesh material 12 where melting of the mesh material 12 ceases propagation of the flames, and/or by action of the flame retardant characteristics of the mesh material 12 to self-extinguish the ignited portion of the mesh material 12. The non-absorbent material characteristic of the mesh material 12 prevents absorption of moisture from rain or snow or ambient moisture in high moisture and/or water areas. Additionally, the non-absorbent material is advantaged by the ability to repel and/or not absorb other types of fluids, including flammable fluids which may be sprayed and/or thrown onto the mesh material 12 and ignited in an attempt to breach 104 and/or damage the entanglement obstacle 10. The non-absorption of flammable fluids in combination with the self-extinguishing flame retardant properties and/or the melting (non-burning) characteristics of the mesh material 12 combine to decrease the susceptibility of the entanglement obstacle 10 to damage by flame, fire, explosion or incendiary device.

In one example, the mesh material 12 may be a knotted mesh material 12, such as a seine netting, made of nylon having a strand diameter of 0.065 inches (1.651 mm) corresponding to a #21 twine size, and where the knotted strands are configured to define square mesh openings 27 sized 5 inches by 5 inches in an unstretched condition, e.g., characterized by a mesh dimension K of 5 inches. The example is non-limiting, and mesh material 12 made of other materials, having other twine sizes, mesh opening sizes and shapes, etc., may be used.

Figure 3:
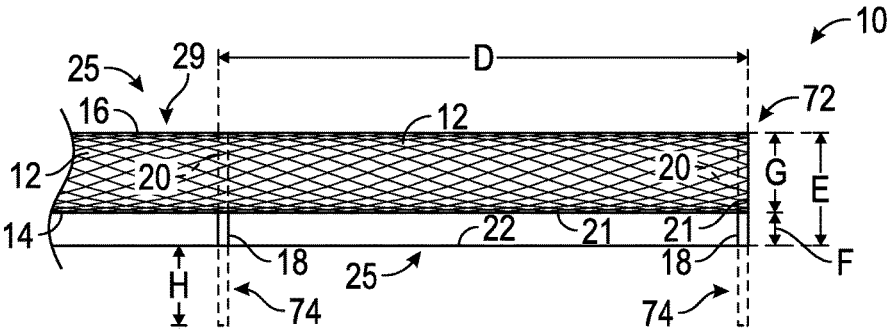
FIG. 3 is a schematic partial plan view of section 3-3 of the entanglement obstacle of FIG. 1.

As shown in FIG. 2, the position of the central posts 20 relative to the perimeter posts 18 determines the incline or slope of the suspended mesh layer 25, which may be expressed in terms of the angle J shown in FIG. 2 or in terms of rise over run. For example, referring to FIGS. 1 and 2, the slope of the protected side of the mesh layer 25 may be expressed as G divided by C1, e.g. (G/C1), where the rise G of the mesh layer 25 is the difference between the central height E and the perimeter height F, and C1 is the width of the entanglement obstacle 10 from the central posts 20 to the perimeter posts 18 adjacent the protected area 33. Likewise, the slope of the intruder side of the mesh layer 25 may be expressed as G divided by C2, e.g. (G/C2), where C2 is the width of the entanglement obstacle 10 from the central posts 20 to the perimeter posts 18 adjacent the intruder area 35. The central posts 20 may be located equidistant between the opposing perimeter posts 18, such that C1=C2 and the slopes of the two sides of the mesh layer are equivalent. The central posts may be located such that C1≠C2, such that the slopes of the two sides of the mesh layer 25 are not equivalent and one side is steeper than the other. The slope and mesh shape and size may be arranged such that from a side perspective as shown in FIG. 3, e.g., from the perspective viewed by an intruder on foot approaching the entanglement obstacle 10, the mesh layer 25 appears to be denser and/or to have smaller openings than the mesh layer 25 appears when viewed from a top perspective. As such, an approaching intruder may receive a visual impression that the mesh layer 25 is dense enough or has small enough openings to be traversable by the intruder, e.g., that the intruder may be able to walk over and/or be supported by the mesh layer 25.

In the non-limiting example shown in FIG. 1, the perimeter posts 18 and the central posts 20 are generally aligned with each other transversely and longitudinally. It would be understood that other arrangements of the perimeter and central posts 18, 20 may be use. For example, the central posts 20 and perimeter posts 18 may be offset relative to each other in either or both of the transverse and longitudinal directions to provide a more irregular structure. Similarly, the central posts 20 and perimeter posts 18 may be positioned to define an obstructed area 37 which is curvilinear rather than linear as shown in FIG. 1.

The mesh layer 25 may include a single mesh panel 23 having a panel width sufficient to extend the obstructed depth B when the mesh panel 23 is affixed to the perimeter and central cables 14, 16 and operatively affixed to the perimeter and central posts 18, 20. The mesh layer 25 may include two or more mesh panels 23 which are operatively affixed to the perimeter and central cables 14, 16 and/or posts 18, 20 to form the continuous mesh layer 25 providing an obstructed depth B and an obstructed length A in the installed position. By way of example, and as shown in FIG. 1, the mesh layer 25 may include first and second mesh panels 23. The first mesh panel 23 may be configured to extend the obstructed length A and the obstructed width C1, where the periphery 21 of the first mesh panel 23 is operatively affixed to the central posts 20 and to the perimeter posts 18 adjacent the protected area 33. The second mesh panel 23 may be configured to extend the obstructed length A and the obstructed width C2, where the periphery 21 of the first mesh panel 23 is operatively affixed to the central posts 20 and to the perimeter posts 18 adjacent the intruder area 35. The first and second mesh panels 23 may be operatively attached to each other, for example, by seaming or otherwise joining the panels 23, 94, or may be joined, for example, by the central cable 16 extending through the mesh openings 27 of the peripheries 21 of the first and second panels 23, 94 forming the central portion 29 of the mesh layer 25. The first and second mesh panels 23, 94 may overlap each other at the central portion 29.

The mesh layer 25 and/or mesh panels 23 are connected to the perimeter and central cables 14, 16 such that the mesh layer 25 is not completely taut but includes sufficient slack such that the mesh layer 25 is dynamically stretchable and, in the installed condition, does not provide a firm surface across which an intruder could walk or climb. The mesh layer 25 is suspended with sufficient dynamic slack such that the strands of the mesh layer 25 are movable in response to a force imposed by an intruder so that strands of the mesh layer 25 move away from and/or around the contacting foot, leg, hand, arm, etc. to receive the contacting member, e.g., the contacting foot, leg, hand, arm, etc. into the mesh opening 27 and/or to entangle the contacting member in the mesh opening 27 and or with the mesh strands 24. The mesh layer 25 is sufficiently, but not completely, taut such that the mesh layer 25 is not in contact with the ground surface 22 below the mesh layer 25 and generally cannot be weighted or stretched to provide anything more than point contact with the ground surface 22 when contacted by or under the weight of an intruder. In the central portion 29 of the mesh layer 25 adjacent the central posts 20, the mesh layer 25 is suspended at sufficient height above the ground surface 22 and is sufficiently taut such that the mesh layer 25 preferably does not make contact with the ground surface 22 when stretched by contact by or under the weight of an intruder. As such, a clearance is maintained between the central portion 29 of the mesh layer 25 and the ground surface 22 at all times and an intruder member or limb (foot, leg, hand, arm) extending through a mesh opening 27 in the central portion 29 to the ground surface 22 is not readily extracted from the opening, for example, without the intruder rising to an upright position to attempt to extract the ensnared limb from the mesh layer 25. By forcing the intruder into an upright position, the intruder is more readily observed and/or may be more easily targeted by defenders taking containment or offensive action against the intruder. The mesh layer 25 may be dynamically stretchable in its installed condition such that objects propelled onto the mesh layer 25, such as incendiary devices configured to explode on impact, bounce off of the mesh layer 25 and/or bounce relative to the mesh layer 25, to reduce the impact force sensed by the device and potentially prevent discharge and/or explosion of the device.

The entanglement obstacle 10 may be strategically placed near or adjacent a protected area 33 including one or more surveillance points 31, as shown in FIG. 2. A surveillance point 31 may, for example, be capable of positioning and/or housing personnel and/or devices to survey the obstructed area 37 including the entanglement obstacle 10, to observe and/or detect intruders attempting to traverse the entanglement obstacle 10, and/or to take defensive or other actions to contain the intruders and/or prevent further progress of the intruders toward the protected area 33, which may include firing on and/or otherwise immobilizing the intruders. The surveillance devices may be automated or non-automated, mechanical, electrical, etc. and may include visual, audio, thermal, and/or other types of surveillance. The surveillance point(s) 31 may be in communication with other detection devices such as cameras, mechanical or laser trip wires, and/or thermal sensing devices, etc. which may be located proximate to and/or within the obstructed area 37 to detect the presence of an intruder in the obstructed area 37 and/or in contact with the entanglement obstacle 10. The other detection devices may be integrated into and/or integral to the entanglement obstacle 10. For example, one or both of the perimeter cables 14 and central cable 16 may be instrumented or otherwise configured as a detection sensor such as a trip wire such that intruder contact with the perimeter and/or central cable 14, 16 at a threshold level may actuate a signal from the detection sensor which is transmittable to the surveillance point 31, to signal that an intruder has been detected. Laser lines may be configured such that movement and/or deflection of the mesh layer 25 in a pattern which interrupts the laser line may actuate a signal to the surveillance point 31 indicating the presence of a weighted object on the mesh layer 25 and/or deflecting or otherwise disturbing the nominal or expected position of the mesh layer 25 relative to the laser line.

Figure 5:
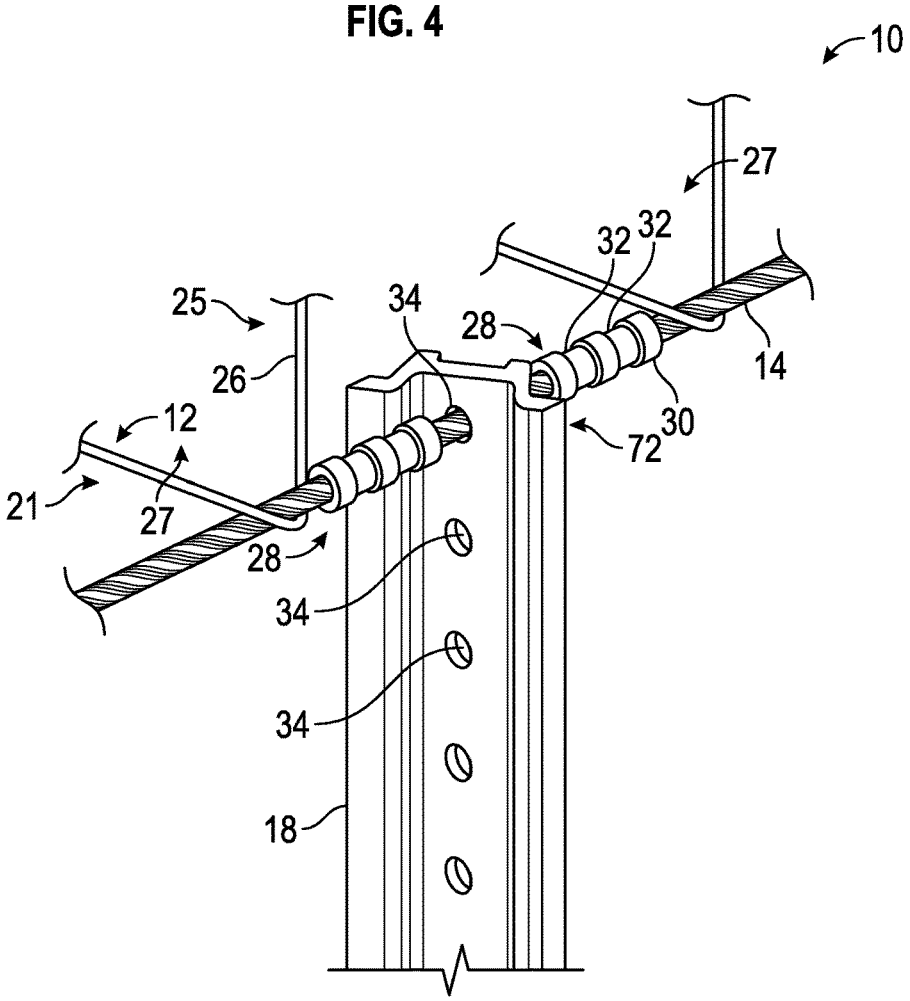
FIG. 5 is a schematic perspective partial view of section 5-5 of the entanglement obstacle of FIG. 4.
Figure 6:
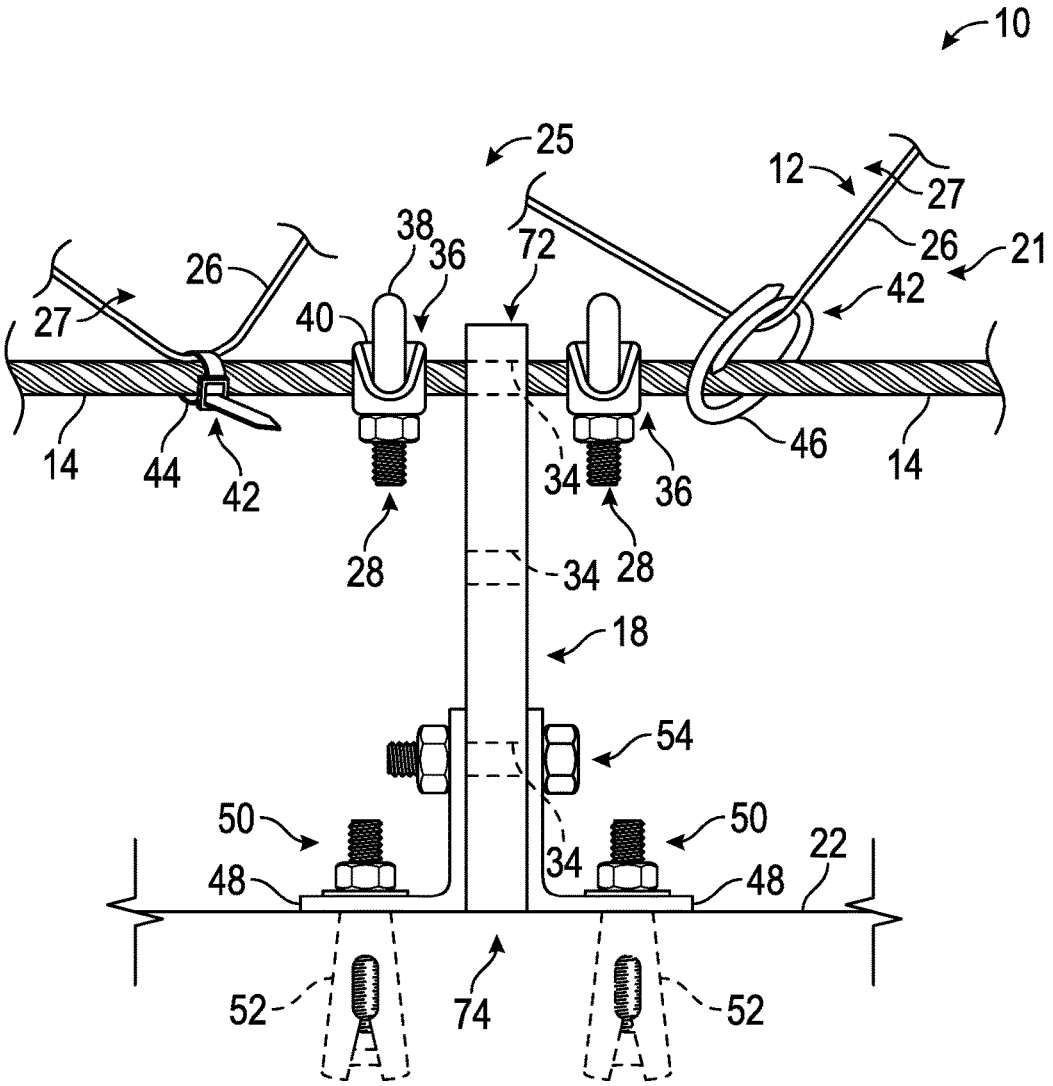
FIG. 6 is a schematic partial plan view of the entanglement obstacle of FIG. 5 showing alternative configurations.

Referring now to FIGS. 4-6, methods for attachment of the mesh layer 25 via the perimeter and central cables 14, 16 to, respectively, the perimeter and central posts 18, 20, are shown in further detail. For simplicity of illustration, FIGS. 4-6 show a perimeter cable 14 attached to a perimeter post 18. However it would be understood that the attachment method described herein and illustrated by these figures is applicable to both the attachment of the mesh layer 25 to the perimeter cable 14 and perimeter posts 18, and the attachment of the mesh layer 25 to the central cable 16 and central posts 20. As shown in a non-limiting example in FIGS. 4-6 illustrated using a perimeter cable 14 and perimeter post 18 and the periphery 21 of the mesh layer 25, the post may be configured to define post opening 34 located adjacent or proximate a first post end, also referred to herein as a post top 72 end or a post top 72. The post opening 34 is configured to receive the cable 14, 16, such that the cable 14, 16 passes through the post opening 34. The cable 14, 16 may be a metal cable, which may be a multi-strand twist cable. In one example, the metal cable may be a galvanized steel cable or a stainless steel cable such that the cable is corrosion resistant. By way of example, the cable 14, 16 may have a cross-sectional diameter of 1/16 inch to 1/4 inch. In the example shown, the cable 14, 16 is a stainless steel twist cable having a diameter of 5/16 inch. In one example, the metal cable may be encased or coated with a casing or coating to camouflage the cable 14, 16, increase corrosion resistance of the cable 14, 16 and/or to decrease abrasion or wear of the mesh layer 25 in contact with the cable 14, 16. The coating may be a metal containing coating, such as a galvanizing coating, or may be a non-metallic or polymeric coating. The casing may be, for example, a polymeric casing.

Alternatively, the cable 14, 16 may be looped through the post opening 34 and doubled back and fastened, crimped, clipped or clamped to retain the cable 14, 16 adjacent the post opening 34. As shown in FIGS. 2-3 and 6, the second post end, also referred to herein as the post base 74, is affixed relative to the ground surface 22 such that the post 18, 20 is retained in its position relative to the ground surface 22. In a first example shown in FIGS. 2 and 3, the post 18, 20 may be driven and/or otherwise inserted into the ground surface 22 to a post depth H, where the post depth H is sufficient to prevent ready removal of the post 18, 20 from the ground by an intruder. By way of example, the post depth H may be 12 to 18 inches. In one example, the post depth H is at least 15 inches. The post 18, 20 may be retained in a footing, such as a concrete footing (not shown) formed in the ground around the post base 74.

In another example shown in FIG. 6, the post 18, 20 may be retained to the ground surface 22 using one or more brackets 48, for example a stand-off bracket 48 or other bracket 48 combination fastened to the ground surface 22. In the example shown in FIG. 6, the ground surface 22 may be a concrete surface and the brackets 48 may be fastened to the concrete ground surface 22 by anchors 50 or fasteners 50 suitable for attaching to concrete. In the present example, the fasteners may be anchor sleeve fasteners 50, each fastener including an expandable sleeve 52 which is expanded by upon tightening the anchor bolt 50 to retain the fastener 50 in the concrete. The post 18, 20 may be fastened to the brackets 48 by a fastener 54 as shown in FIG. 6, or may otherwise be affixed to the bracket 48, for example, by welding or other means sufficient to prevent ready disengagement of the post from the bracket 48 by an intruder.

By way of example, the post 18, 20 may be a cut length of sign post channel stock having post openings 34 at spaced intervals, such that the perimeter posts 18 and central posts 20 are readily fabricated from standard, e.g., off the shelf available material which may be cut to length as required for each of the perimeter and central posts 18, 20. The total post length is determined by the sum of the post depth H and the respective post height E, F required for the post 18, 20, and such that the post opening 34 is positioned at the post top 72 so the cable and mesh layer 25 can be affixed to the post top 72 without the post top 72 significantly protruding above the mesh layer 25, to minimize detection of the post location by an intruder. The post 18, 20 may be made from a material of sufficient strength and corrosion resistance to support the mesh layer 25 and cable structure of the entanglement obstacle 10. By way of non-limiting example, the post 18, 20 may be made from a stainless steel or galvanized steel material, and may optionally be treated by painting, coating or otherwise treated to provide corrosion protection. Galvanized steel or stainless steel posts 18, 20 are preferred, however it would be understood that the entanglement obstacle 10 could be constructed using perimeter and central posts 18, 20 made of other materials 12, 68 as available at the installation site. Other post materials may include other metals such as aluminum, high strength polymers, wood including wood posts, tree limbs, etc. The mesh layer 25 and/or cables 14, 16 may be attached to trees, rocks 58, etc. where necessitated by the installation conditions and/or need to substitute in situ materials for one or more of the perimeter or central posts 18, 20 during installation.

The perimeter and central posts 18, 20, perimeter and central cables 14, 16, and/or the mesh layer 25 may be painted, coated, or otherwise treated or finished to provide a predetermined visual appearance, which may be a camouflaged appearance. In one example shown in FIG. 13, camouflaging material 68 such as foliage or other camouflaging garnish 68 may be applied and/or attached to the mesh material 12 to blend with a surrounding environment. The color and/or appearance of the mesh layer 25 may be configured to blend and/or camouflage the entanglement obstacle 10 relative to one or more of a grassy, wooded, dirt, desert, concrete, asphalt, and water containing environment, and/or be camouflaged to prevent detection by aerial observation.

Figure 15:
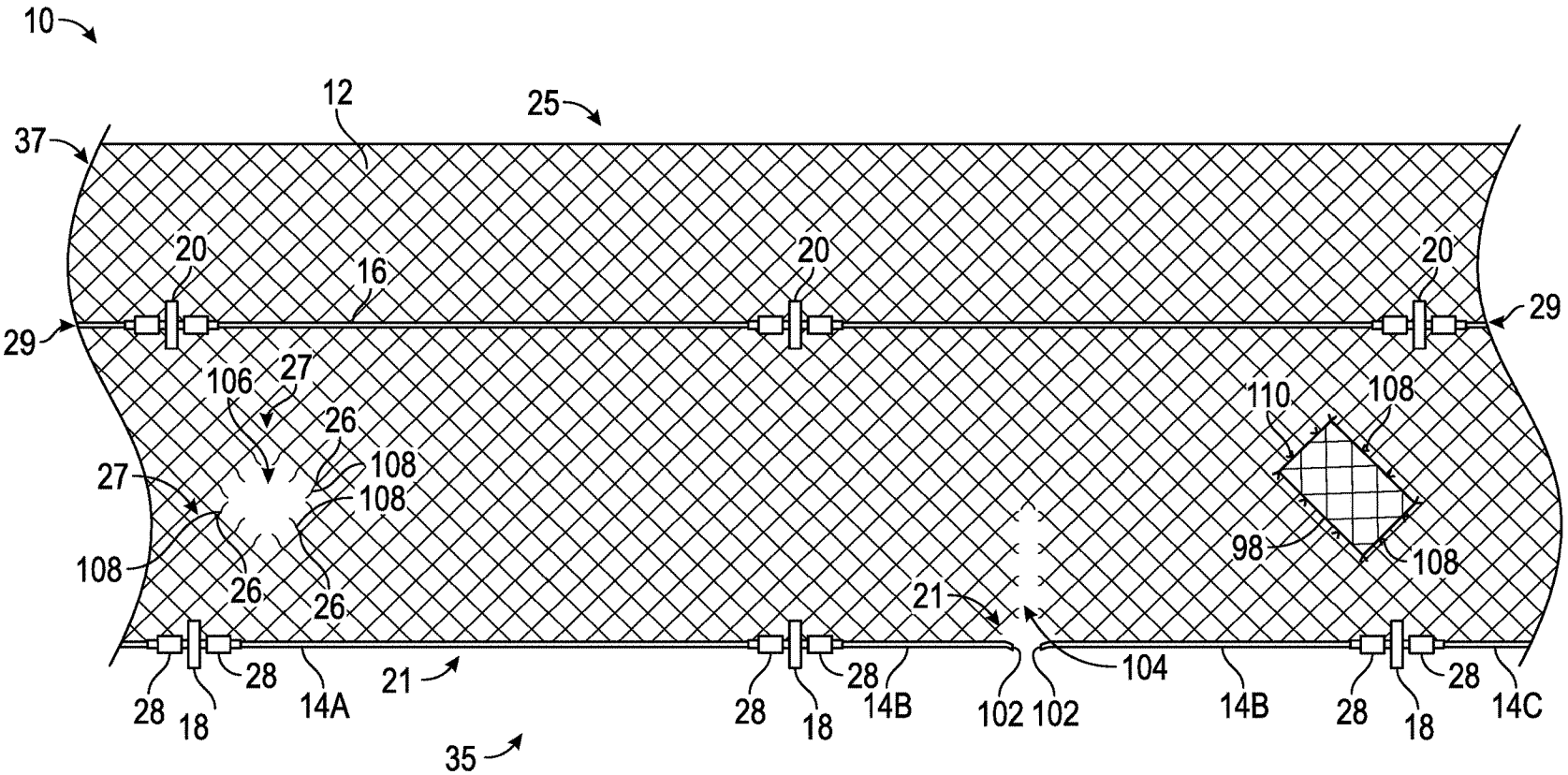
FIG. 15 is a schematic partial top view of the entanglement obstacle of FIG. 1 including a mesh panel patch.

Referring again to FIGS. 4-6, the cable 14, 16 may be inserted through the post opening 34 and a cable retainer 28 operatively attached to the cable 14, 16 on both sides of the post opening 34, such that the cable 14, 16 is retained in position relative to the post and post opening 34, and such that, in the event the cable 14, 16 is severed on either side of the post opening 34, the non-severed portion is retained to the post by the cable retainers 28 affixed to the cable 14, 16 on both sides of the post 18, 20. As shown in FIG. 15, a cable segment, identified in a non-limiting example as a cable segment 14B of the perimeter cable 14, may be severed at cable ends 102 by an intruder attempting to traverse the entanglement obstacle 10, causing a loss of tension of the cable segment 14B, and loss of some, but not all, of the tension at the periphery 21 of the mesh layer 25 adjacent the cable segment 14B, which continues to be substantially tensioned by portions of the mesh layer 25 retained by adjacent cable segments 14A and 14C, which remain intact. As shown in FIG. 15, because cable segment 14A is retained to the perimeter post 18 between cable segments 14A and 14B by the cable retainers 28 affixed to the cable 14 on either side of the perimeter post 18, cable segment 14A and the portion of the mesh layer 25 attached to cable segment 14A remains intact and tensioned between the perimeter posts 18 even through the cable segment 14B has been cut. Similarly, because the cable segment 14C is retained to the perimeter post 18 between cable segments 14C and 14B by the cable retainers 28 affixed to the cable 14 on either side of the perimeter post 18, cable segment 14C and the portion of the mesh layer 25 attached to cable segment 14C remains intact and tensioned and supporting the section of the mesh layer 25 adjacent cable segment 14B.

By way of non-limiting example, FIGS. 4-6 show two different types of cable retainers 28 which may be used in constructing the entanglement obstacle 10. In a first example shown in FIGS. 4-5, the cable 14, 16 may be extended through a pair of sleeves 30, where the sleeves 30 of the pair are located on opposing sides of the post opening 34. The sleeve 30 is configured such that in the installed position the sleeve 30 presents a cross-section larger than the post opening 34 such that the sleeve 30 cannot be passed through the post opening 34 and the cable 14, 16 cannot be removed from the post opening 34 without removing at least one of the cable retainers 28 and/or severing the cable 14, 16 between the post and the cable retainer 28. As such, it is preferred that the cable retainers 28 be positioned and affixed to the cable 14, 16 proximate to the post, e.g., as close to the post as possible, to minimize access to the cable 14, 16 between the cable retainer 28 and the post by, for example, cable cutters (not shown). The cable retainer 28 shown in FIGS. 4-5 may be a crimpable sleeve 30 which is readily crimped in the field during installation of the entanglement obstacle 10 to retain the cable 14, 16 to the post 18, 20. The crimpable sleeve 30 may have a generally cylindrical or oval cross section and define a longitudinal through hole to receive the cable 14, 16. After the cable 14, 16 is positioned and/or tensioned relative to the post 18, 20, the crimpable sleeve 30 is slid on the cable 14, 16 into position close to the post 18, 20, and crimped to form crimped portions 32, to thereby retain the sleeve 30 to the cable 14, 16. In another example, the crimpable sleeve 30 may be a split sleeve 30 including a longitudinal slot (not shown) to allow the sleeve 30 to be slipped onto the cable 14, 16 after the cable 14, 16 has been inserted through a plurality of post openings 34 and/or after the cable 14, 16 has been tensioned in position. The slotted crimpable sleeve 30 is inserted onto the cable 14, 16 such that the cable 14, 16 is received through the slot into the sleeve 30, the crimpable sleeve 30 is positioned on the cable 14, 16 next to the post 18, 20 and crimped to form the crimped portions 32 such that the crimped portions 32 retain the sleeve 30 to the cable 14, 16 and at least partially close the slot around the cable 14, 16.

In another example shown in FIG. 6, the cable retainer 28 may be configured as a saddle 40 clip, also referred to as a Crosby clamp 36. The Crosby clamp 36 includes a U-bolt 38 and a saddle 40. The saddle 40 includes a recessed surface (not shown) and openings (not shown) to receive the legs of the U-bolt 38 in an installed position. In use, the Crosby clamp 36 is retained to the cable 14, 16 as shown in FIG. 6, where the cable 14, 16 is entrapped between the U-portion of the U-bolt 38 and the recessed surface of the saddle 40, and the U-bolt 38 is retained to the saddle 40 by fasteners, which in the example shown are nuts attaching the threaded legs of the U-bolt 38 to the saddle 40. The nuts may be tightened to a predetermined torque to ensure the cable retainer 28 is fixedly attached to the cable 14, 16. As with the crimpable sleeve 30, the Crosby clamp 36 is preferably located as close as possible to the post opening 34 to minimize access to the cable 14 between the Crosby clamp 36 and the post opening 34 by cable cutters. The examples of cable retainer 28 configurations shown in FIGS. 4-6 are non-limiting, and would be understood that other configurations of clips, clamps, retainers and/or cable fasteners may be used to retain the cable 14, 16 in position relative to the post 18, 20 and such that the cable 14 with the cable retainer 28 attached cannot be passed through the post opening 34.

By way of non-limiting example, FIGS. 4-6 show two different methods of attaching the mesh layer 25 to the cable 14. In both examples, the attachment of the periphery 21 of the mesh layer 25 to the perimeter cable 14 is shown; however, it is understood these same methods may be used in attaching the mesh layer 25 to the central cable 16. As shown in FIGS. 4-5, the mesh layer 25 may be attached to the cable 14, 16 by extending the cable 14, 16 through openings in the mesh material 12 such that the mesh layer 25 is retained to the cable 14, 16. This installation method requires alternating insertion of the cable 14, 16 through a post, a plurality of openings in the mesh layer 25, another post, more openings in the mesh layer 25, etc. This method is advantaged by requiring no additional fasteners, e.g., the mesh layer 25 is directly attached to the cable 14, 16 via the mesh openings 27. The mesh strand 24 could be cut and tied around the cable 14, 16 to attach the mesh layer 25 to the cable 14, 16, as an alternative to inserting the cable 14, 16 through the mesh openings 27. This may be a consideration when mesh clips or ties 42 are not available, and/or when a portion of the mesh layer 25 must be attached to the cable 14, 16 after the cable 14, 16 has been affixed to the posts 18, 20 for example, during repair or replacement of all or a portion of the mesh layer 25.

Alternatively, the mesh layer 25 may be attached to the cable 14, 16 as shown in FIG. 6, using a mesh clip 42 which may be used to attach the mesh layer 25 to the cable 14, 16 either after or during installation of the cable 14, 16 to the plurality of posts 18, 20. In one example, the mesh clip 42 may be a tie strap 44, also referred to as a cable strap 44, which is looped around a mesh strand 24 of the mesh material 12 and the cable 14, 16. The tie strap 44 may be made of a polymeric material such that the tie strap 44 is resistant to corrosion and chemical attack, and non-abrasive to the mesh material 12 and/or the cable 14, 16. The end of the tie strap 44 is inserted through the locking element of the tie strap 44 and tightened to attach the mesh strand 24 to the cable 14, 16. The size of the loop of the tie strap 44 is adjustable during installation, such that the loop size may be varied to compensate for tension requirements of the mesh layer 25. No installation tools are required for assembly of the tie strap 44.

In another example shown in FIG. 6, a mesh clip 42 made of metal may be used to attach the mesh strand 24 to the cable 14, 16. In a preferred example, the metal is corrosion resistant, such as a stainless steel or galvanized steel material and is compatible with the mesh material 12 and the cable material such one element does not cause corrosion, abrasion and/or wear of the other connected elements. In one example, the mesh clip 42 may be coated with a metallic coating, such as a galvanizing coating, or a non-metallic coating, such as a polymeric coating, to increase corrosion resistance, decrease abrasion between the mesh clip 42 and the mesh layer 25 and/or the cable 14, 16, and/or to camouflage the mesh clip 42. The mesh clip 42 may be a hog ring 46 which is easily applied by deforming the generally C-shaped or open triangle-shaped hog ring 46 around the mesh strand 24 and the cable 14, 16 using hog ring 46 pliers and/or conventional pliers if hog ring 46 pliers are not available. In either example, attachment of the mesh layer 25 to the cable 14, 16 is easily and readily accomplished using lightweight, standardized fasteners and tools. The examples shown are non-limiting and it would be understood that other configurations of mesh clips 42 may be used including snap clips, non-metallic clips, etc. FIGS. 4-6 illustrate various examples of attachment of the periphery 21 of the mesh layer 25, e.g., the outermost mesh openings 27 of the mesh layer 25, to the cable 14, 16. These examples are non-limiting and it would be understood that the mesh layer 25 may be attached to the cable 14, 16 such that non-peripheral strands of the mesh material 12 may be attached to the cable 14, 16, for example, to locally adjust tension of the mesh layer 25 adjacent the cable attachment, to provide for a draping or extension of peripheral mesh material 12 over the cable 14, 16 to cover and/or camouflage the cable 14, 16 as a trip wire and/or to cover the opening between the cable 14, 16 and the ground surface 22. In another example (not shown) multiple strands of the mesh material 12 may be attached by the mesh clip 42 to the cable 14, 16, such that in the event one of the strands is broken by abrasion, cutting, etc., the remaining strand or strands continue to attach the mesh layer 25 to the cable 14, 16 in position, maintaining the integrity of the mesh panel 23 and the entanglement obstacle 10.

Figure 7:
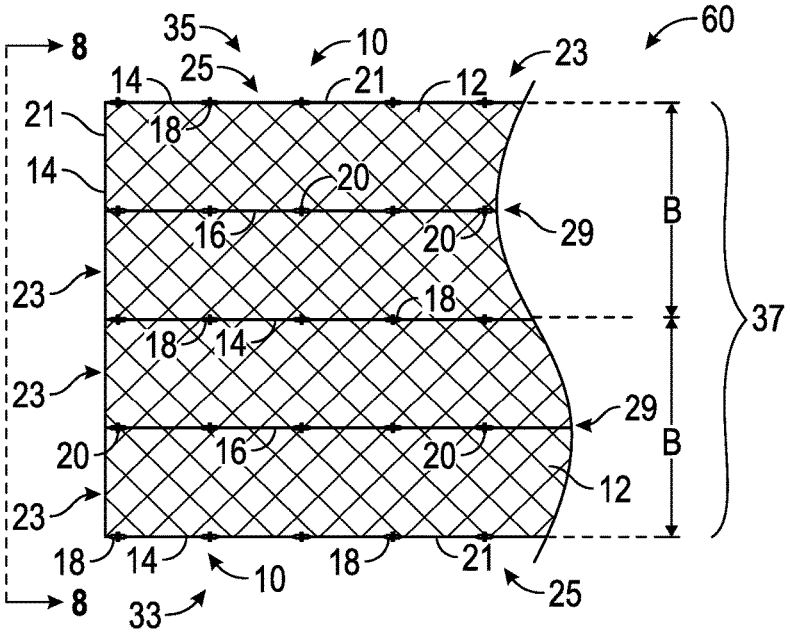
FIG. 7 is a schematic top view of an entanglement band including a plurality of entanglement obstacles such as the entanglement obstacle of FIG. 1.
Figure 8:
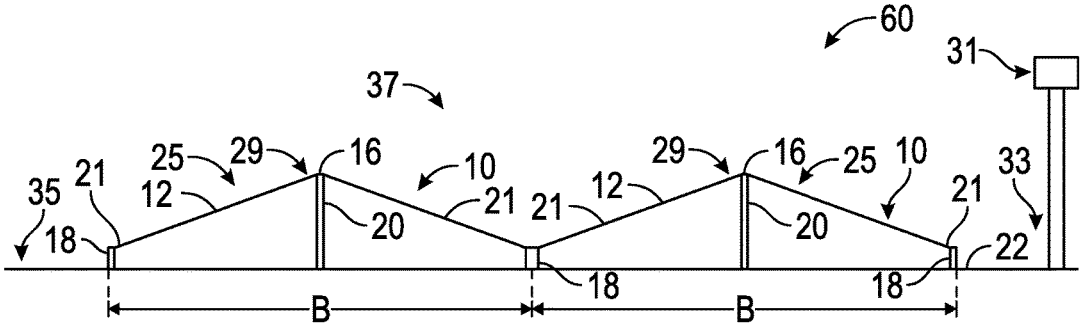
FIG. 8 is a schematic end view of the entanglement band of FIG. 7.

Referring now to FIGS. 8-14, non-limiting examples of obstacles 60, 70, 80, 90, 100 including at least one entanglement obstacle 10 in conjunction with at least one other obstacle are illustrated. FIGS. 7-8 show an entanglement band 60 consisting of at least two entanglement obstacles 10, where each individual entanglement obstacle 10 may be referred to as an entanglement belt 10. The entanglement belts 10 are positioned next to each other with little or no clearance between the adjacent peripheral portions of the abutting mesh layers 25. In the example shown, the adjacent entanglement belts 10 may both be attached to a shared perimeter cable 14 and shared perimeter posts 18 at the abutting surfaces of the mesh layers 25, reducing the amount of perimeter posts 18, cable 14, cable retainers 28 and/or mesh clips 42 required to install the entanglement band 60. It would be understood that the configuration shown is optional and each entanglement belt 10 may be installed with separate, e.g., non-shared, perimeter posts 18 and cables 14, 16. The obstacle depth in the example shown is double the obstacle depth B of each of the entanglement belts 10. In one example, the obstacle depth of the example shown in FIGS. 7-8 is approximately 60 feet. The configuration shown may be varied such that more than two entanglement belts 10 are installed adjacent each other to extend the obstructed depth as a multiplier of B, or the obstructed depth of each of the entanglement belts 10 may be varied to cover the obstructed area 37 with an entanglement band 60 which includes a plurality of elevated central portions 29 to increase the difficulty of traversing the entanglement band 60 by introducing multiple changes in elevation and slope of the mesh layers 25 forming the entanglement band 60.

Figure 9:
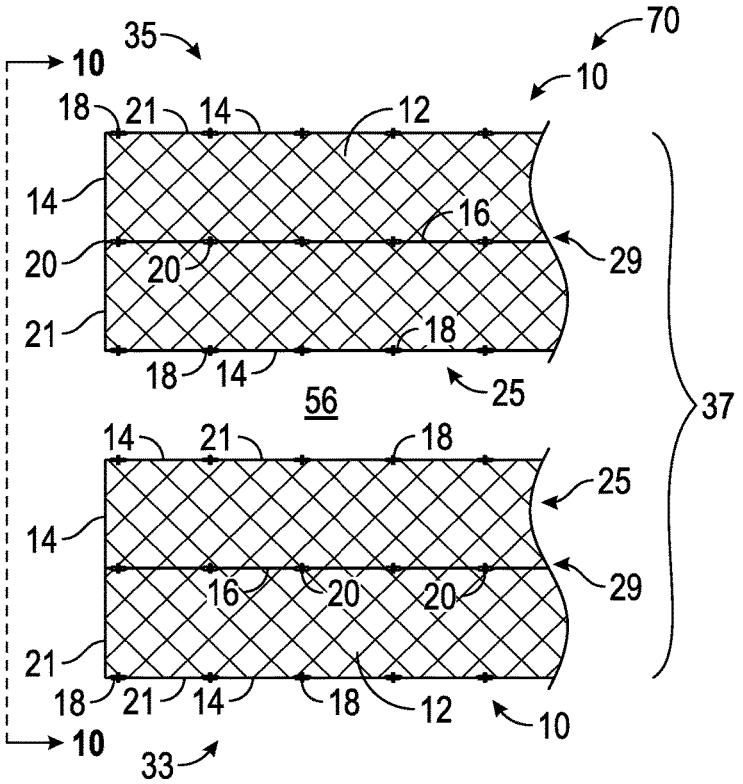
FIG. 9 is a schematic top view of an entanglement zone including a plurality of entanglement obstacles such as the entanglement obstacle of FIG. 1.
Figure 10:
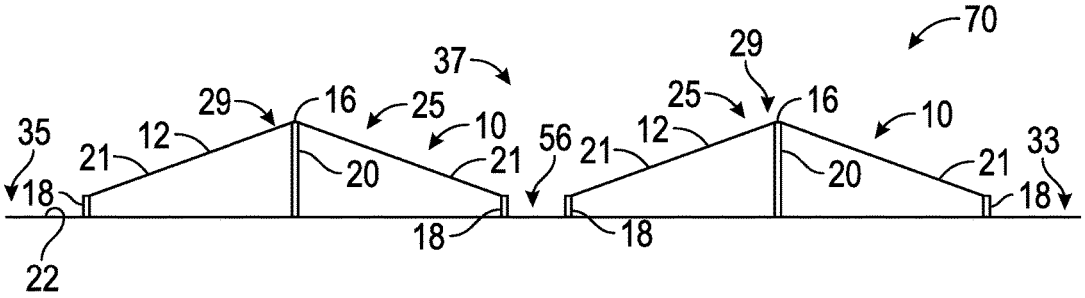
FIG. 10 is a schematic end view of the entanglement zone of FIG. 9.

FIGS. 9-10 show an entanglement band 70 consisting of at least two entanglement belts 10 which are positioned next to each other with a lane 56 in between, to provide an entanglement zone 70. The obstacle depth in the example shown is greater than 2B, e.g., more than double the obstacle depth B of each of the entanglement belts 10. The configuration shown may be varied such that more than two entanglement belts 10 are installed adjacent each other to extend the obstructed depth of the entanglement zone 70, or the obstructed depth of each of the entanglement belts 10 may be varied to cover the obstructed area 37 with an entanglement band 60 which includes a plurality of elevated central portions 29 to increase the difficulty of traversing the entanglement band 60 by introducing multiple changes in elevation and slope of the mesh layers 25 forming the entanglement band 60. An entanglement belt 10 may be positioned adjacent the entanglement band 60 of FIG. 8 with a lane 56 therebetween to form another configuration of an entanglement zone 70. It would be understood that various combinations of multiple entanglement belts 10 may be used to form entanglement zones 70 which may include one or more entanglement bands 60. The lane 56 between the entanglement belts 10 may be maintained as a clear lane 56 for example, for unencumbered passage of authorized personnel along the obstructed length of the entanglement zone 70 to inspect and/or maintain the entanglement obstacles 10. Optionally, trip wires, intruder sensing devices, other obstacles such as barbed or razor wire concertina coils 82, and/or other hazards or impediments may be installed in the lane 56 to impede and/or deter intruders attempting to traverse the entanglement zone 70 and gain access to the protected area 33.

Figure 11:
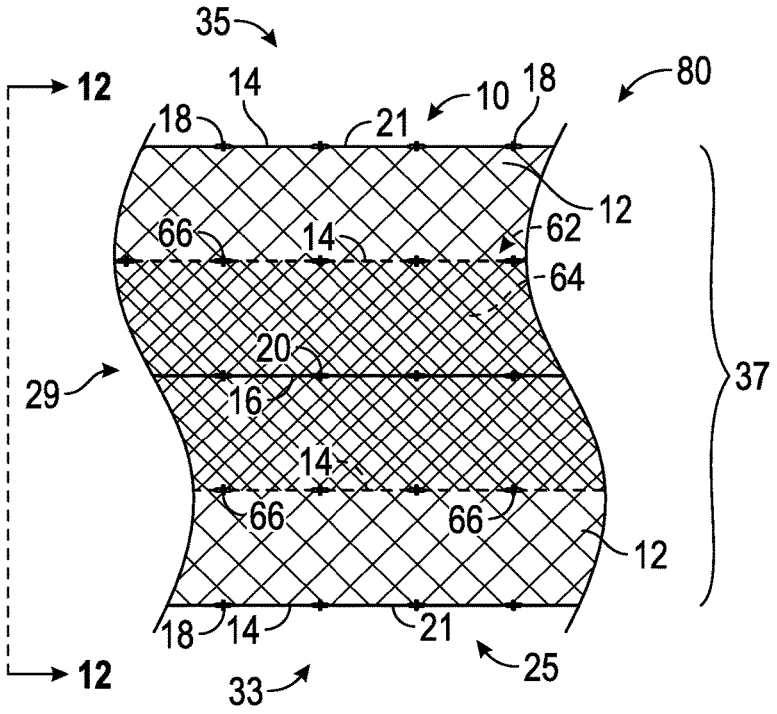
FIG. 11 is a schematic top view of a layered entanglement obstacle including the entanglement obstacle of FIG. 1.
Figure 12:
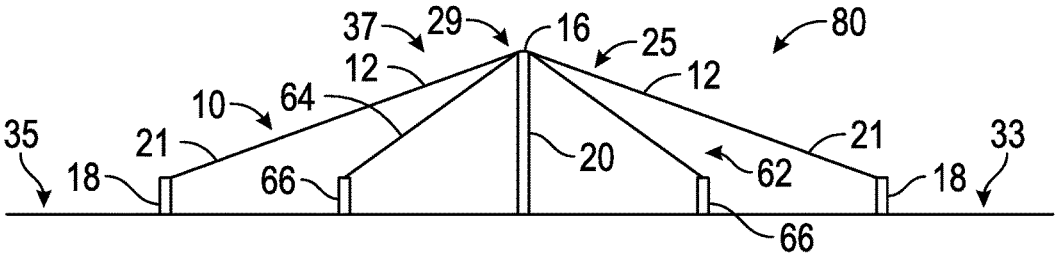
FIG. 12 is a schematic end view of the layered entanglement obstacle of FIG. 11.

FIGS. 11 and 12 show a multi-layer entanglement obstacle 80 which includes layered first and second mesh layers 25, 64 each having a central portion 29 attached to a common set of central posts 20. The second entanglement hazard 62 is positioned under the first entanglement obstacle 10, and is configured such that the second mesh layer 64 is attached at or near its periphery 21 to a perimeter cable 14 attached to a second set of perimeter posts 18, and such that the second mesh layer 64 is suspended between the first mesh layer 25 and the ground surface 22. The first and second mesh layers 25, 64 cooperate to increase the entanglement potential presented to an intruder attempting to traverse the multi-layer entanglement obstacle 80. For example, an intruder limb which protrudes through and/or becomes entangled in the first mesh layer 25 may also protrude through and/or become entangled in the second mesh layer 64, increasing the difficulty of and amount of effort and time required to extract the ensnared limb from the multiple layers 25, 64 of mesh material 12, thus extending the amount of time the intruder is detained in the entanglement obstacle 10 and/or required to maintain an upright position to extract the entangled limb, increasing the intruder's susceptibility to observation by surveillance and/or containment or other immobilizing actions taken by the personnel and/or devices of the protected area 33.

Figure 14:
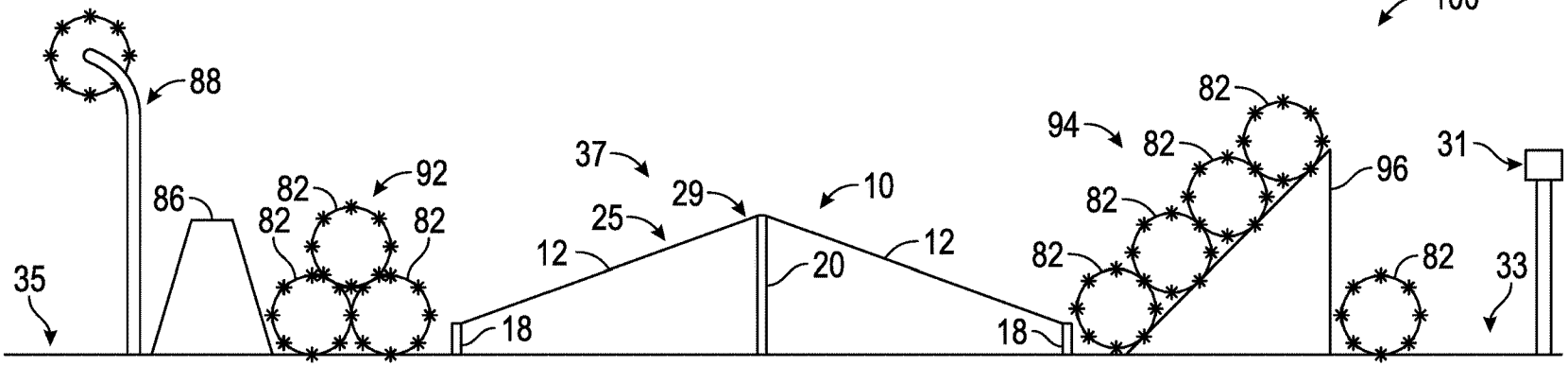
FIG. 14 is a schematic end view of a multi-obstacle barrier including the entanglement obstacle of FIG. 1.

FIGS. 13 and 14 show combination entanglement obstacles 90, 100 including at least one entanglement obstacle 10 positioned relative another type of obstacle. As previously discussed, FIG. 13 shows an entanglement obstacle 10 including a mesh layer 25 which has been camouflaged, in the non-limiting example, by camouflage garnish 68 such as foliage, to camouflage the mesh layer 25 and/or to obscure the tripping obstacles 58, terrain obstacles 78, and concertina coils 82 positioned below the mesh layer 25 from observation and/or detection by intruders. In another example shown in FIG. 14, the entanglement obstacle 10 may be positioned in a multi-obstacle barrier 100 as shown, between other obstacles 82, 86, 88, 92, 94, 96 arranged to extend the obstructed depth of the obstructed area 37. In the example shown, an intruder attempting to access the protected area 33 by traversing the obstructed area 37, beginning from the intruder area 35, must traverse a fence 88, which may be a barbed wire and/or electrified fence 88, a vehicle barrier which may be comprised of a series of cement blocks 86, a triple concertina fence 92, the entanglement obstacle 10, and an inclined concertina panel 94 including a vertical panel 96 terminating into a concertina coil 82. The obstructed area 37 and/or the multi-obstacle barrier 100 may further include other obstacles, intruder sensors, trip wires, etc. The obstacle depth and complexity of the multi-obstacle barrier 100 increases the time and means by which an intruder may be deterred and/or impeded from traversing the obstructed area 37, thereby increasing the probability of observation of the intruder from the surveillance point 31 and the time available to initiate action to contain, capture or otherwise immobilize the intruder, thereby impeding and/or preventing access by the intruder to the protected area 33.

In addition to the advantages of the entanglement obstacle 10 including the mesh layer 25 previously discussed herein, the entanglement obstacle 10 described herein presents advantages related to resistance to being cut and/or fired upon, and advantages related to repairability, portability and reusability. For example, metal wire entanglements which use tightly strung wire to create trip hazards and tanglefoot obstacles are disadvantaged by the strung wire being taut and fixed in position making it possible to expeditiously cut through the strung wire with wire cutters, without the intruder having to hold onto the wire prior to or during the cutting operation. In contrast, the mesh layer 25 of the obstacle 10 described herein is not completely taut, e.g., has a certain amount of dynamic slack as described previously, such that the mesh layer 25 must be manually manipulated and/or held in contact with a cutting device by an intruder during a cutting operation. As such, cutting through the mesh layer 25 is substantially more time consuming and requires more manipulation of the mesh layer 25 as compared with a metal wire entanglement, thereby impeding a breach of the entanglement obstacle 10 and delaying progress toward the protected area 33 by an intruder. Further, as shown in FIG. 15, cutting one strand of the mesh breaches only two mesh openings 27 in the mesh material 12, and numerous cuts would be required to create any significant hole 106 or cut path 104 in the mesh. Limiting access by an intruder or group of intruders to a cut path 104 channels the intruders into a localized area within the obstructed area 37, where a targeted offensive action may be taken by the surveillance point 31 to immobilize or otherwise contain the localized group of intruders.

The obstacle 10 is further advantaged by being readily repairable, including being readily repaired in the field, using lightweight and easily portable materials such as replacement mesh material 12, lengths of repair cable, cable retainers 28, mesh clips 42, and/or minimal tools. For example, a replacement piece of mesh material 12 can be tied into the existing mesh layer 25 and/or to the cables 14, 16 to patch a hole 106 or breach 104 in the panel (See FIG. 15). A length of repair cable may be spliced into the perimeter cable 14 and/or the central cable 16 as required to replace a cable segment removed by a breach attempt, where the repair cable may be connected to the ends of the cable 14, 16 being repaired using crimpable sleeves 30, Crosby clamps 36, etc. Cable ends 102 which have become disconnected, for example, by being cut by an intruder attempting to breach the obstacle 10, may be reconnected using sleeves 30 or Crosby clamps 36. Existing hardware on the entanglement obstacle 10 may be redeployed to repair more critical portions of the entanglement obstacle 10 in the absence of available replacement materials. For example, portions of the mesh material 12 may be removed from the protected side of the mesh layer 25 to patch the intruder side of the mesh layer 25 by attaching the patch 98 to the mesh panel 23 using a series of repair knots 110, to ensure the integrity of the intruder side 35, e.g., the side of the entanglement obstacle 10 first approached by an intruder, is maintained. Crosby clamps 36 used in the original installation as cable retainers 28 may be redeployed from the protected side of the perimeter cable 14 to splice in replacement cable segments to repair the intruder side of the entanglement obstacle 10, again ensuring priority is placed on maintaining the integrity of the intruder side to entangle and/or deter intruders upon entry of the intruders into the entanglement obstacle 10 for earliest detection and/or containment of the intruders.

The entanglement obstacle 10 may be dismantled with minimal damage to any of the mesh layer 25, the perimeter and central cables 14, 16, and the posts 18, 20, such that these may be reused, reconfigured, transported to a new location and/or reassembled. As such, the entanglement obstacle 10 is characterized by enhanced reusability and portability as compared with, for example, barbed wire or razor wire containing obstacles, which are difficult to handle without special equipment, may be non-recoverable and non-reusable, and are heavier to transport.

While the best modes for carrying out the disclosure have been described in detail, those familiar with the art to which this disclosure relates will recognize various alternative designs and embodiments for practicing the disclosure within the scope of the appended claims.

The invention claimed is:

1. An obstacle for obstructing an area of a surface, the obstacle comprising:

a mesh layer;

a periphery defined by the mesh layer;

a central portion of the mesh layer extending from a first end of the mesh layer to a second end of the mesh layer;

wherein the central portion is bounded by the periphery;

wherein the mesh layer in an installed position is extended continuously over a surface such that an obstructed area of the surface is defined by the periphery of the mesh layer;

a plurality of perimeter upright members distributed along the periphery;

a plurality of central upright members distributed within the periphery;

wherein in the installed position a first end of each of the perimeter upright members is attached to the surface on the periphery;

wherein in the installed position a first end of each of the central upright members is attached to the surface within the obstructed area;

a perimeter cable attached to the periphery of the mesh layer and to a second end of each of the perimeter upright members;

a central cable attached to the central portion of the mesh layer and to a second end of each of the central upright members;

wherein a central clearance is defined between the central cable and the surface;

wherein a perimeter clearance is defined between the perimeter cable and the surface; and wherein the central clearance is greater than the perimeter clearance.

2. The obstacle of claim 1, wherein:

an entanglement length is defined between the first and second ends of the mesh layer;

the plurality of central upright members are distributed between the first and second ends of the mesh layer; and the central cable extends continuously from the first end of the mesh layer to the second end of the mesh layer.

3. The obstacle of claim 1, further comprising:

a trip impediment, wherein the trip impediment includes the perimeter cable; and a step over impediment, wherein the step over impediment includes the central cable.

4. The obstacle of claim 3, wherein a step over height of the step over impediment is defined by the central clearance; and wherein the step over height is such that a person can step over the central cable.

5. The obstacle of claim 4, wherein the step over height is not less than eighteen inches.

6. The obstacle of claim 1, wherein each of the perimeter upright members includes an opening extending through the second end of the perimeter upright member; and wherein the perimeter cable is attached to the perimeter upright member such that the perimeter cable passes through the opening.

7. The obstacle of claim 6, wherein the opening extends through the perimeter upright member from a first side of the perimeter upright member to a second side of the perimeter upright member;

the obstacle further comprising:

a first cable retainer affixed to the perimeter cable adjacent the first side of the perimeter upright member; and a second cable retainer affixed to the perimeter cable adjacent the second side of the perimeter upright member.

8. The obstacle of claim 1, wherein each of the central upright members includes an opening extending through the second end of the central upright member; and wherein the central cable is attached to the central upright member such that the central cable passes through the opening.

9. The obstacle of claim 1, further comprising:

the first mesh layer including a plurality of mesh openings; and wherein each mesh opening is characterized by a mesh dimension between 4 inches and 6 inches.

10. The obstacle of claim 1, further comprising:

at least one tripping obstacle disposed between the surface and the mesh layer;

wherein the tripping obstacle has a height less than the central clearance.

11. The obstacle of claim 1, wherein the mesh layer is a first mesh layer;

the obstacle further comprising:

a second mesh layer suspended between the first mesh layer and the surface;

wherein a perimeter clearance of the second mesh layer is less than the perimeter clearance of the first mesh layer.

12. The obstacle of claim 1, further comprising:

at least one concertina coil positioned between the mesh layer and the surface such that the at least one concertina coil is adjacent at least one of the central upright members.

13. The obstacle of claim 1, further comprising:

a plurality of mesh clips distributed along the periphery of the mesh layer;

wherein each of the mesh clips is attached to the perimeter cable and to the periphery of the mesh layer.

14. The obstacle of claim 1, wherein:

the perimeter cable is made of metal and configured such that the perimeter cable is resistant to cutting.

15. The obstacle of claim 1, further comprising:

a detection device actuable to detect movement by an intruder of at least one of the perimeter cable, the mesh layer, and the central cable.

16. The obstacle of claim 15, further comprising:

wherein the detection device is located within the obstructed area.

17. A method of deploying an obstacle to obstruct an area of a surface with the obstacle, the method comprising:

extending a mesh layer over an area of a surface;

wherein the mesh layer defines:

a periphery; and a central portion of the mesh layer extending from a first end of the mesh layer to a second end of the mesh layer;

wherein the central portion is bounded by the periphery;

wherein the mesh layer in an installed position is extended continuously over the surface such that an obstructed area of the surface is defined by the periphery of the mesh layer;

intertwining a perimeter cable with the mesh layer along the periphery of the mesh layer;

distributing a plurality of perimeter upright members along the periphery;

distributing a plurality of central upright members within the periphery;

attaching a first end of each of the perimeter upright members to the surface on the periphery;

attaching a first end of each of the central upright members to the surface within the obstructed area;

attaching the perimeter cable to a second end of each of the perimeter upright members;

attaching a central cable to the central portion of the mesh layer and to a second end of each of the central upright members;

wherein a central clearance is defined between the central cable and the surface;

wherein a perimeter clearance is defined between the perimeter cable and the surface; and wherein the central clearance is greater than the perimeter clearance.

18. The method of claim 17, wherein:

an entanglement length is defined between the first and second ends of the mesh layer;

the plurality of central upright members are distributed between the first and second ends of the mesh layer; and the central cable extends continuously from the first end of the mesh layer to the second end of the mesh layer.

19. The method of claim 17, wherein attaching the perimeter cable to the second end of each of the perimeter upright members further comprises:

passing the perimeter cable through an opening extending through the second end of the perimeter upright member;

affixing a first cable retainer to the perimeter cable adjacent the opening and a first side of the perimeter upright member; and affixing a second cable retainer to the perimeter cable adjacent the opening and a second side of the perimeter upright member.

20. An obstacle for obstructing an area of a surface, the obstacle comprising:

a mesh layer which in an installed position is extended continuously over a surface such that an obstructed area of the surface is defined by a periphery of the mesh layer;

wherein the periphery is continuous such that a central portion of the mesh layer is bounded by the periphery;

a plurality of perimeter upright members distributed along the periphery;

a plurality of central upright members distributed within the periphery;

wherein in the installed position a first end of each of the perimeter upright members is attached to the surface on the periphery;

wherein in the installed position a first end of each of the central upright members is attached to the surface within the obstructed area;

a perimeter cable extended along the periphery and attached to a second end of each of the perimeter upright members;

wherein perimeter cable is attached to the mesh layer along the periphery of the mesh layer;

a central cable attached to the central portion of the mesh layer and to a second end of each of the central upright members;

wherein a central clearance is defined between the central cable and the surface;

wherein a perimeter clearance is defined between the perimeter cable and the surface;

wherein the central clearance is greater than the perimeter clearance;

wherein the mesh layer is made of a mesh material; and wherein the perimeter cable and the central cable are each made of a material which is not the mesh material.

* * * * *